United States Patent [19]

Simpson, Jr. et al.

[11] Patent Number: 4,750,339

[45] Date of Patent: Jun. 14, 1988

[54] EDGE BINDING FOR FABRIC ARTICLES

[75] Inventors: Ralph H. Simpson, Jr., Roaring River; Jimmy W. Luffman, Wilkesboro, both of N.C.

[73] Assignee: Golden Needles Knitting & Glove Co., Inc., Wilkesboro, N.C.

[21] Appl. No.: 14,946

[22] Filed: Feb. 17, 1987

[51] Int. Cl.[4] ..... D04B 9/46

[52] U.S. Cl. ..... 66/172 R; 66/172 E; 66/174; 66/190; 66/202; 2/162

[58] Field of Search ..... 2/162; 66/169 A, 172 R, 66/172 E, 174, 190, 202

[56] References Cited

U.S. PATENT DOCUMENTS

| | | | |
|---|---|---|---|
| Re. 24,384 | 10/1957 | Elder et al. . | |
| 2,111,353 | 3/1938 | Berry | 66/174 |
| 2,286,771 | 6/1942 | Thurston . | |
| 2,308,593 | 1/1943 | Brew | 66/202 X |
| 2,380,003 | 7/1945 | Whitehead . | |
| 2,460,674 | 2/1949 | Bihaly . | |
| 2,578,889 | 12/1951 | Kennedy . | |
| 2,703,887 | 3/1955 | Kennedy . | |
| 2,811,029 | 10/1957 | Conner . | |
| 3,015,223 | 1/1962 | Moore . | |
| 3,226,275 | 12/1965 | Kiess . | |
| 3,578,546 | 5/1971 | Morancy | 66/172 E |
| 3,906,750 | 9/1975 | Routh et al. . | |
| 3,996,771 | 12/1976 | Routh et al. . | |
| 4,069,090 | 1/1978 | Boyer . | |
| 4,133,191 | 1/1979 | Blore et al. | 66/169 A X |
| 4,526,828 | 7/1985 | Fougt et al. . | |
| 4,534,819 | 2/1987 | Payet et al. . | |

FOREIGN PATENT DOCUMENTS

| | | | |
|---|---|---|---|
| 2016851 | 11/1970 | Fed. Rep. of Germany | 66/169 A |
| 1348779 | 12/1963 | France | 66/190 |
| 50-37790 | 12/1975 | Japan | 66/202 |

OTHER PUBLICATIONS

Man-Made Fiber and Textile Dictionary, Celanese Corp., 1975, pp. 6, 7, and 119.

Morton et al., Physical Properties of Textile Fibers, Wiley & Sons, N.Y., 1975, p. 602.

*Primary Examiner*—Ronald Feldbaum

*Attorney, Agent, or Firm*—Cullen, Sloman, Cantor, Grauer, Scott & Rutherford

[57] ABSTRACT

A knitted article such as a glove having a wrist cuff includes an edge binding which is activatable by the application of heat thereto to prevent unraveling of the cuff edge. The bound edge is defined by first and second yarn ends which are knitted together, wherein the first yarn includes a heat activatable, thermoplastic outer covering and the second yarn is defined by a nonthermoplastic, elastic material. The first and second yarns are knitted in a manner to form crossover points therebetween. The edge binding is subjected to heat in order to melt the thermoplastic outer covering of the first yarn, thereby joining the first and second yarns at the crossover points. The articles may be formed on conventional, automatic knitting machines. The knitted articles are ejected from the machine and are gravity fed into a heated chamber in order to melt the thermoplastic outer covering of the first yarn, and thereby bind the edge of the article.

25 Claims, 4 Drawing Sheets

EDGE BINDING FOR FABRIC ARTICLES

TECHNICAL FIELD

The present invention broadly relates to woven and knitted textiles, and deals more particularly with a construction for binding the edge or selvage of an article such as a glove so as to prevent the edge from unraveling.

BACKGROUND ART

In connection with woven and knitted articles, it is often necessary to bind the free edges of the article to prevent unraveling thereof. This is particularly important in connection with knitted articles in which one or more yarns are loosely knitted together and can become easily unraveled unless the edges thereof are bound in some manner. For example, knitted gloves typically include a cuff which is knitted integrally with the hand portion of the glove. The upper edge of the cuff must be bound in a manner which prevents unraveling of the glove.

One prior approach to binding the cuff edge involves sewing the cuff edge in a second machine operation following the first machine operation of knitting the glove. This approach to the problem, while quite effective, is expensive in terms of labor and the additional equipment needed to perform the sewing operation.

Another approach to binding the cuff edge involves the use of heat activatable thermoplastic yarns in the cuff edge which can be melted by the application thereto of heat, thereby binding the cuff edge. The cuff edge used in this construction consists of a single end of yarn having an outer covering of thermoplastic material. The single yarn end is knitted together to form the edge. Upon application of heat to the thermoplastic yarn, bonds are formed at the crossover points of the yarn. It has been found, however, that when the edge is subjected to stress, as when the wearer inserts a hand through the cuff thereby enlarging the cuff, the yarn bonds, thus allowing the yarn to eventually unravel. As a consequence, prior art edge bindings employing heat activatable, thermoplastic yarns were largely unsatisfactory. Furthermore, it was necessary to employ specially dedicated machines for melting the knitted, thermoplastic yarn after the article had been knitted.

The present invention is intended to overcome each of the shortcomings of the prior art mentioned above.

SUMMARY OF THE INVENTION

According to the present invention, a binding is provided for the edge or selvage of a woven or knitted article, such as the cuff of a glove in order to prevent unraveling of the article. The binding includes first and second yarn ends which are associated with each other to form crossover points therebetween. The first yarn includes a heat meltable thermoplastic outer covering and the second yarn includes a nonthermoplastic outer covering. The edge is subjected to heat of a temperature sufficiently high to melt the thermoplastic outer covering of the first yarn. Melting of the outer covering of the first yarn results in the formation of thermoplastic bonds between the first and second yarns at the crossover points, thereby forming a binding which prevents unraveling of the article. In the preferred form of the invention, the first and second yarns includes an elastic core, such as rubber.

It is therefore a primary object of the present invention to provide an edge binding for knitted or woven articles which is highly effective in preventing unraveling but yet is cost effective to manufacture.

Another object of the invention is to provide an edge binding as discussed above which employes a heat activatable thermoplastic material which is woven or knitted into the edge.

A still further object of the invention is to provide an edge binding as described above which is effective in preventing unraveling of the edge even when subjected to stresses or stretching.

Another object of the invention is to provide an edge binding as described above which includes thermoplastic and nonthermoplastic yarns which are bonded together at their crossover points.

A still further object of the invention is to provide an edge binding as discussed above in which the thermoplastic and nonthermoplastic yarns each possess elasticity.

These, and further objects and features of the present invention will be made clear or will become apparent during the course of the following description of the preferred embodiment of the present invention.

BRIEF DESCRIPTION OF THE DRAWINGS

In the drawings, which form an integral part of the specification and are to be read in conjunction therewith, and in which like reference numerals are employed to designate identical components in the various views.

DESCRIPTION OF THE PREFERRED EMBODIMENTS

Figure 1:
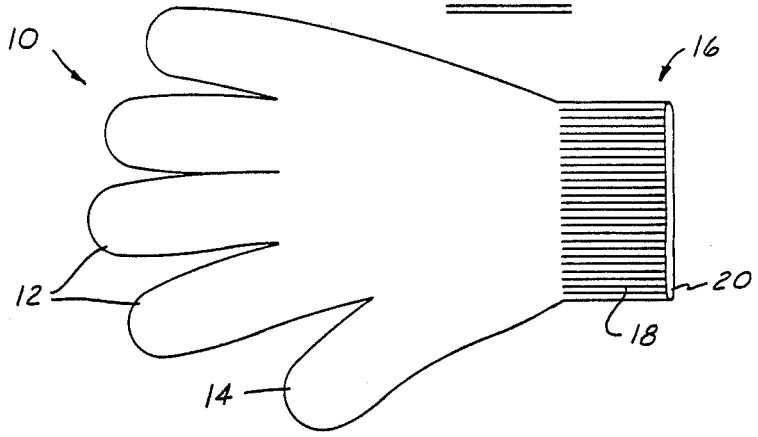
FIG. 1 is a plan view of a glove having a cuff provided with an edge binding that forms the preferred embodiment of the present invention.

The present invention relates to a woven, non woven or knitted article, such as the knitted glove generally indicated by the numeral 10 in FIG. 1. The glove 10 includes knitted fingers 12, a knitted thumb 14 and a cuff 16 which is knitted integrally with the hand of the glove 10. The cuff 16 typically includes elastic ribs 18 which allow expansion of the cuff 16 to allow a user to insert his or her hand into the glove 10. The cuff 18 includes an outer edge 20 which is bound in accordance with the present invention to prevent unraveling of the cuff 18. The glove 10 may be knitted or woven of any of various yarns such as cotton, acrylic, kevlar, etc. The cuff 16 is typically woven or knitted of the same material forming the hand of the glove, but preferably includes an elastic yarn to provide the cuff 16 with an elastic characteristic so that the cuff 16 fits snugly around the wrist of the wearer. In the case of the knitted glove 10, the elastic yarn is effectively interlaced into alternating courses of the knitted yarn.

Figure 2:
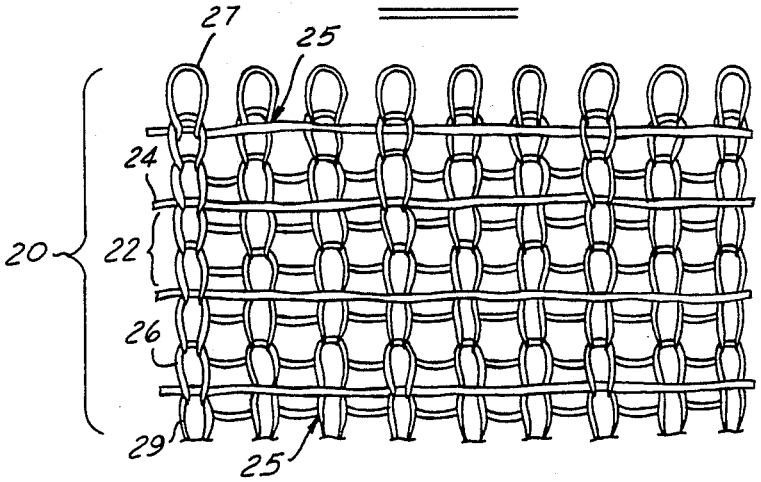
FIG. 2 is an enlarged, fragmentary view of the edge binding shown in FIG. 1, prior to the activation of the thermoplastic yarn.

The details of the edge binding 20 are depicted in FIG. 2 wherein only the last several courses of the cuff 18 are depicted. It should be noted here that the edge binding 20 may consist of more or less than the specific number of courses shown in the drawings courses and that the embodiment illustrated in FIG. 2 is merely exemplary. Each course of the edge binding 20 comprises two rows 22 of a first yarn end 26 formed into a weft knit, and a second yarn end 24. The second yarn end 24 is effectively interlaced through alternating groups of columns of the knitted chains defined by the first yarn end 26. Each column of chains defined by the first yarn end 26 is terminated in free loops 27. The yarn 24 is associated with the chains of the first yarn 26 so as to form points of intersection or crossover points 25 which will be discussed later in more detail.

Figure 3:
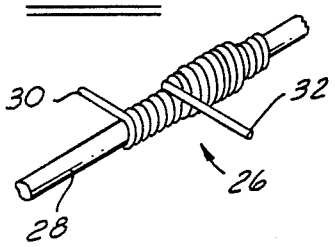
FIG. 3 is a fragmentary, perspective view of one yarn end employed in the edge binding which includes a thermoplastic outer covering.

The yarn end 26 is depicted in more detail in FIG. 3. Yarn end 26 includes an inner core 28 which is preferably of an elastic material such as rubber. The rubber core 28 is wrapped in one circumferential direction with a helically wound fiber or filament 30 such as acrylic. The yarn 26 further includes an outer covering defined by a fiber or filament 32 of a thermoplastic material which is helically wrapped around the inner core, in the circumferential direction opposite that of the inner covering 30. The outer covering 32 may comprise any of various well-known thermoplastic materials, such as polyethylene for example, which preferably has a melting point above that normally encountered during ordinary washing of the knitted or woven article but sufficiently low to facilitate melting of the thermoplastic material without the application of excessive heat. For example, a melting point of between 200 and 250 degrees Farenheit would be suitable for many applications.

Figure 4:
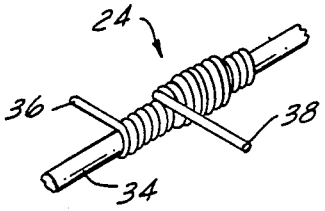
FIG. 4 is a fragmentary, perspective view of another yarn end employed in the edge binding.

The details of the construction of the second yarn end 24 are shown in FIG. 4. The second yarn 24 comprises a core 34 of elastic material such as rubber which is helically wrapped with an inner covering 36 defined by a fiber or filament such as polyester. The yarn 24 further includes an outer covering 38 defined by a filament or fiber of material such as polyester which is helically wrapped in the opposite circumferential direction of the wrapping of the inner covering 36. One yarn suitable for use as the yarn end 24 is available from MacField Texturing Company of Madison, N.C. which is identified by the manufacturers style No. 5439. This yarn has a 50 gage rubber core with the inner and outer coverings 36, 38 respectively comprising 70 denier polyester. The yarn has 315 percent elongation and yields 2.345 yards per pound.

It is important that the diameter of the inner core 28 of the first yarn end 26 be relatively substantial in comparison to the diameter of the inner core 34 of the second yarn end 24. For example, where the inner core 34 of the yarn end 24 to 50 gage, the inner core 28 of the yarn end 26 should be much less than 100, for example about 50 gage, although 85 gage has provided acceptable results. One yarn suitable for use as the first yarn end 26 is available from Supreme Elastic Corporation of Hickory, N.C. and is identified by the manufacturer's Style Number FLOR-M-2000. This yarn has an 85 gage rubber core which constitutes 13.8% of the yarn by weight, an inner wrapped cover of 18/2 Acrylic which constitutes 72.5% of the yarn by weight and an outer wrapped cover of FLOR-M-2000 Thermoplastic which constitutes 13.8% of the yarn by weight. The yarn possesses a relaxed yield of 1482 yarns per pound and an elongation of 240%.

Although not specifically shown in FIG. 2, the construction of the cuff 16 below the binding edge 20 comprises weft knitted chains of a third yarn end 29 (FIG. 5) interspersed with the elastic yarn end 24. The third yarn end 29 is identical to that which makes up the palm, fingers and thumb of the glove 10. In other words, the lower part of the cuff has a construction identical to that depicted in FIG. 2 except that the weft knitted chains comprises a conventional yarn rather than a thermoplastic covered yarn.

Figure 5:
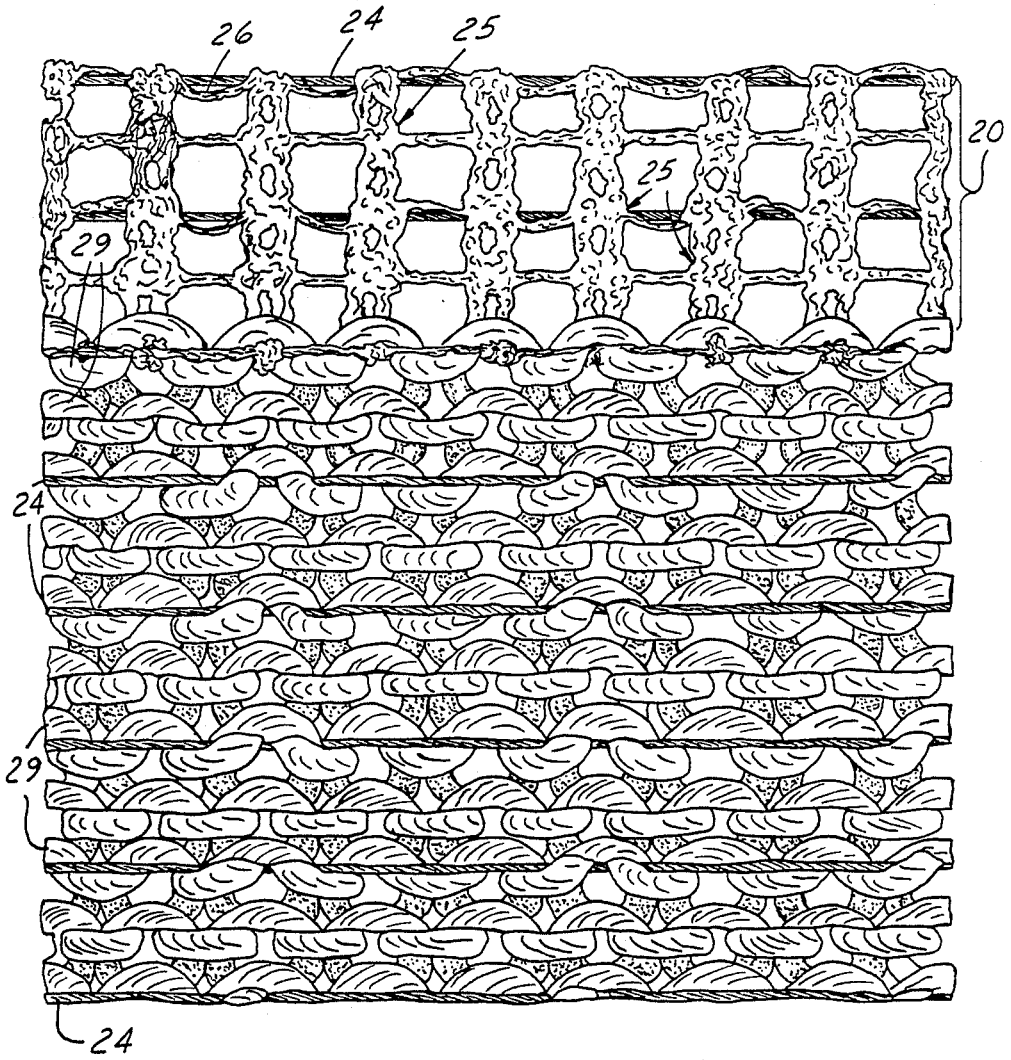
FIG. 5 is a view similar to FIG. 2 but depicting the edge binding after the thermoplastic yarn has been activated.

FIG. 5 depicts an enlarged portion of the cuff 15, and more particularly the binding edge 20 as well as a portion of the cuff 16 below the binding edge 20, after the application of heat to the cuff 16. The application of heat to the binding edge 20 results in the melting of the thermoplastic outer covering 32 of the first yarn 26. This melting or "activation" of the thermoplastic outer covering can be accomplished by any of various known techniques including the use of a heated medium such as steam or air, or the application of microwave energy. In any event, as can be seen in FIG. 5, the melting of the outer thermoplastic covering 32 results in the formation of thermoplastic bonds between the first and second yarn ends 24, 26 at the crossover points 25. The second yarn 24 functions to hold the thermoplastic bonds in place. Moreover, because the second yarn 24 is elastic, the thermoplastic bonds are allowed to stretch somewhat along with the elongation of the second yarn 24 when the binding edge 20 is stretched, thereby preventing breakage of these bonds. Additionally, the diameter of the inner core 28 of the first yarn end 26 is sufficient such that such core 28, in combination with the second yarn end 24 provides a matrix to hold and support the melted thermoplastic material. The above mentioned cooperation effectively prevents the first and second yarn ends 24 and 26 from separating each other which would otherwise result in unraveling of the cuff 18.

Figure 6:
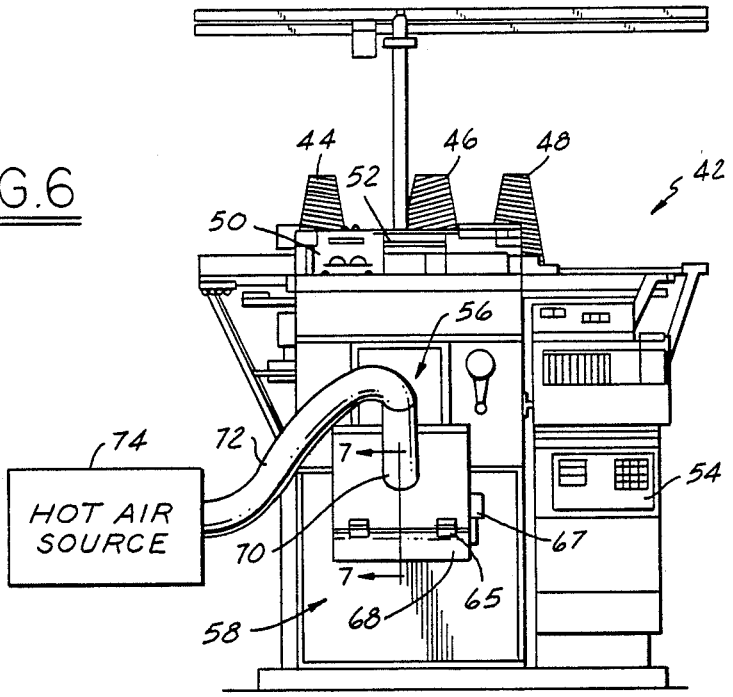
FIG. 6 is a front elevational view of a machine for knitting the glove shown in FIG. 1 and for activating the thermoplastic yarn of the edge binding; and, FIG. 7 is a sectional view taken along the line 7—7 in FIG. 6, the open position of the chamber door being indicated in the phantom.
Figure 7:
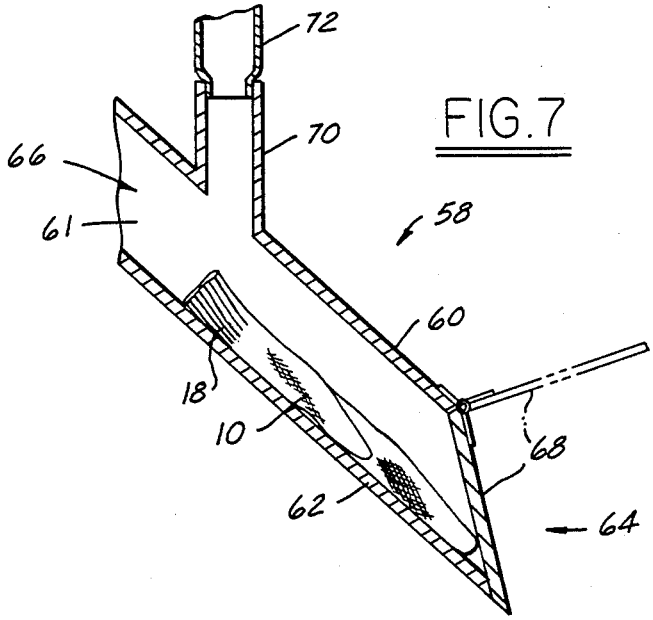
Figure 8:
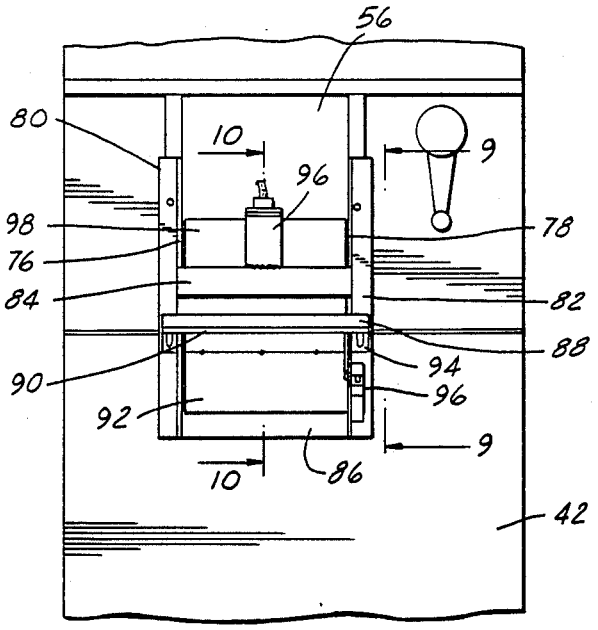
Figure 9:
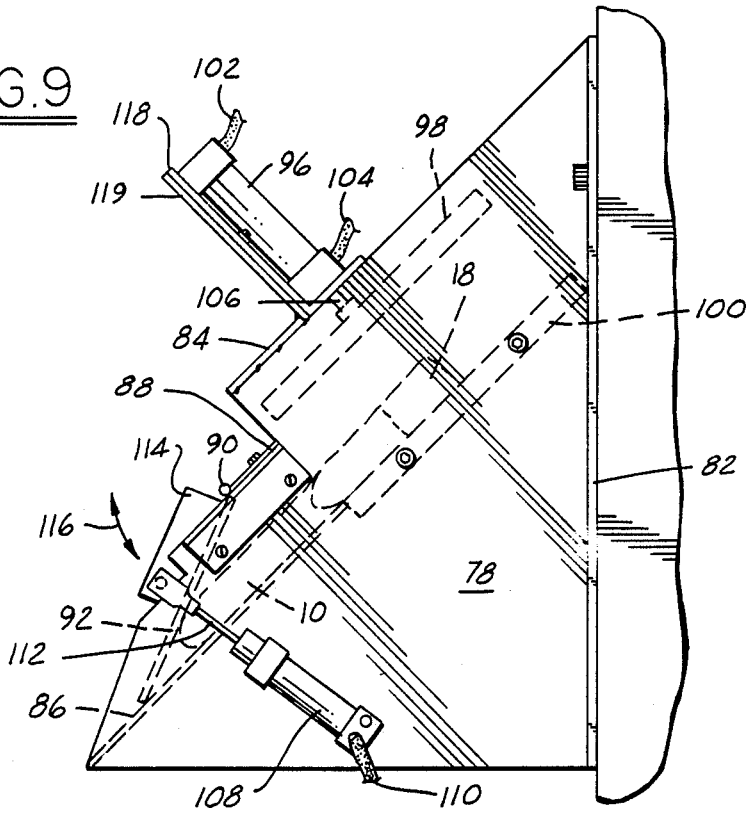

The knitted glove 10 described above having the novel edge binding 20 may be manufactured using the machine depicted in FIGS. 6 and 7. As shown in FIG. 6, a glove knitting machine generally indicated by the numeral 42 automatically knits individual gloves using yarn ends supplied from yarn spools 44–48 which respectively comprise the yarns 24, 26 and 29 discussed above. The yarns from the spools 44–48 are fed to a needle bed (not shown) by means of a yarn feeding carriage 50 mounted for reciprocal movement on rails 52. The mechanisms of the machine 42 are automatically controlled by a computerized controller 54. The machine as thus far described may comprise, by way of example, a model SH-100 high speed finishing machine manufactured by Shima Seiki of Wakayama, Japan.

Upon completion of a knitting cycle, the finished glove is ejected from the front of the machine at an ejection area 56. The machine includes a housing or chamber 58 (FIG. 7) which is mounted on the face of the machine 42, immediately below the ejection area 56. The housing 58 includes an inclined top wall 60, an inclined bottom wall 62 and side walls 61. The upper end of the housing 58 includes an opening 66 thereon immediately below the ejection are 56 which is position so as to receive a glove 10 as it is ejected from the machine 42. The bottom wall 62 is inclined from vertical at approximately a 45 degree angle. The lower end of the housing 58 is selectively closed by a door 68 which is pivotally connected to the top wall 60 by means of hinges 65. In its closed position, shown in full lines in FIG. 7, the door 68 preferably forms a 30 degree angle with respect to the bottom wall 62, thereby functioning to wedge the outer end of the fingers 12 of the glove 10; in this manner the glove 10 is held in a precise, preselected position within the housing 58. The opening and closing of the door 68 is controlled by a conventional pneumatic or electrically operated motor member 67 which is in turn operated by the controller 54.

The top wall 60 of the housing 58 includes a tubular stack 70 through which hot air may be introduced into the interior of the housing 58. The tubular stack 70 is connected by means of a conduit 72 to a conventional source of hot air 74. The hot air source 74 typically includes a heating element for heating the air and an electrically driven blower for forcing the heated air through the conduits 72 into the interior of the housing 58. As best seen in FIG. 7, the tubular stack 70 is positioned immediately above the cuff 18 of the glove 10 so that hot air will impinge upon the binding edge 20.

In operation, after a glove 10 has been knitted by the machine 42, the knitted glove is ejected, fingers 12 first, from the ejection area 56 and the glove 10 slides under the influence of gravity through the opening 66 into the housing 58 and comes to rest with the fingers 12 wedged between the door 68 and the bottom wall 62. The ejection of the glove from the machine 42 is sensed and in response thereto, the controller 54 activates the hot air source 74 so as to introduce hot air through the conduit 72 into the housing 58 for a preselected length of time sufficient to assure that the thermoplastic yarn in the edge binding 20 is properly melted. As mentioned above, the temperature of hot air within the housing 58 is at least as hot as the melting point of the thermoplastic material, e.g., between 200 and 250 degress Fahrenheit. During the period that hot air is introduced to the housing 58, the next glove is being automatically knit on the machine 42. After hot air has been introduced into the housing 58 for the requisite period of time, the controller 54 disables the hot air source 74 and activates the motor member 67 to move the door 68 to its open position, whereupon the glove 10 slides, by influence of gravity, out through the bottom opening 64 in the housing 58. The finished gloves discharged from the housing 58 may be accumulated in any suitable receptacle (not shown). After the glove is ejected from the housing 58, the controller 54 activates the motor member 67 to close the door 68, thereby readying the housing 58 to receive the next glove ejected from the machine 42.

From the foregoing, it is apparent that the novel edge binding described above not only provides for the reliable accomplishment of the objects of the invention but does so in a particularly economical and efficient manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalence thereof fairly within the scope of the invention.

What is claimed is:

1. A cuff edge for use with an article of clothing having a cuff, said cuff edge comprising:

a first yarn having a heat meltable thermoplastic outer covering; and a second yarn interlaced and defining a support for said first yarn to form said cuff edge, said second yarn including an elastic material portion, said interlacement of said second yarn with said first yarn defining crossover points between said first and second yarns, said first and second yarns being joined together at said crossover points between said yarns by thermoplastic bonds formed by melting said thermoplastic outer covering of said first yarn onto said second yarn at said crossover points, wherein said thermoplastic bonds of said cuff edge substantially prevent said cuff from unraveling and wherein said elastic material portion of said second yarn substantially reduces breakage of said thermoplastic bonds when said cuff is stretched.

2. The cuff edge of claim 1, wherein said first yarn includes an elastic core.

3. The cuff edge of claim 2, wherein said elastic core is rubber having a gage of less than 100.

4. The cuff edge of claim 2, wherein said elastic core is rubber having a gage of about 85.

5. The cuff edge of claim 2, wherein said first yarn includes an acrylic inner covering disposed around said elastic core beneath said thermoplastic outer covering.

6. The cuff edge of claim 1, wherein said elastic material portion of said second yarn includes an elastic core.

7. The cuff edge of claim 6, wherein said elastic core is rubber.

8. The cuff edge of claim 6, wherein said elastic core has a gage of about 100.

9. The cuff edge of claim 6, wherein said elastic core has a gage of about 85.

10. The cuff edge of claim 6, wherein said elastic core has a gage of about 50.

11. The cuff edge of claim 6, wherein said first yarn includes an elastic core and the gage of said elastic core of said first yarn is approximately the same as the gage of said elastic core of said second yarn.

12. The cuff edge of claim 6, wherein said second yarn has an outer covering.

13. The cuff edge of claim 12, wherein said second yarn includes an inner covering beneath said outer covering.

14. The cuff edge of claim 1, wherein said first yarn forms a knitted fabric.

15. A binding for the edge of a knitted article to prevent unraveling of said article comprising:

a knitted portion formed of a first yarn having a heat meltable thermoplastic outer cover; and a second yarn interlaced with and defining a support for said first yarn said first yarn including an elastic material portion, said first and second yarns intersecting each other at crossover points and being joined together at said crossover points by thermoplastic bonds formed by melting said thermoplastic outer covering of said first yarn to bond said first yarn to said second yarn at said crossover points such that unraveling of said article is prevented.

16. The binding of claim 15, wherein said first and second yarns each include an elastic core.

17. The binding of claim 20, wherein the cores of said first and second yarns are each rubber and the gage of the core of said first yarn is substantial relative to the gage of the core of said second yarn.

18. The binding of claim 21, wherein the ratio of the gage of the core of said first yarn to the gage of the core of said second yarn is approximately 85:50.

19. A cuff for a knitted glove which fits snugly around the wearer's wrist and which includes a bound outer edge to prevent unraveling of the outer edge of said cuff, comprising:

a plurality of first knitted courses defining the body of said cuff;

a plurality of second knitted courses partially defining said bound outer edge, said plurality of second knitted courses being formed of a first yarn having a core and a thermoplastic outer covering, and a second yarn which includes an elastic material portion, said second yarn being interlaced with and defining a support for said first yarn to form crossover points between said first and second yarns, said first and second yarns being joined together at said crossover points by thermoplastic bonds, said thermoplastic bonds being formed by melting the thermoplastic outer covering of said first yarn onto said second yarn at said crossover points.

20. The cuff of claim 19, wherein said second yarn is formed into knitted courses and said third yarn passes only certain of the knitted courses of said second yarn.

21. The cuff of claim 19, wherein siad elastic material portion of said second yarn is an elastic core and the core of said second yarn is greater in diameter than the elastic core of said first yarn.

22. The cuff of claim 19, wherein said elastic material portion of said second yarn is a rubber core.

23. For use in a cuff which is repeatedly stretched on an article of clothing, an edge binding comprising:

a first yarn having a heat meltable thermoplastic outer covering; and a second yarn interlaced with said first yarn, said second yarn forming a support for said first yarn, said second yarn including an elastic material portion, the interlacement of said first and second yarns defining crossover points between said first and second yarns, said crossover points including thermoplastic bonds between said first and second yarns, said thermoplastic bonds being formed by melting said thermoplastic outer covering of said first yarn to bond said first yarn to said second yarn at said crossover points, wherein said thermoplastic bonds of said edge binding substantially prevent said cuff from unraveling and wherein said second yarn substantially reduces breakage of said thermoplastic bonds when said edge binding is stretched.

24. The edge binding recited in claim 23, wherein said first yarn is knitted to form a portion of said cuff.

25. The edge binding recited in claim 23, wherein said first yarn has an elastic core.

* * * * *